US009034547B2

(12) United States Patent
Joo et al.

(10) Patent No.: US 9,034,547 B2
(45) Date of Patent: May 19, 2015

(54) ELECTROPHOTOGRAPHY TONER

(71) Applicant: Samsung Electronics Co., Ltd., Suwon-si, Gyeonggi-do (KR)

(72) Inventors: Hae-ree Joo, Seoul (KR); Tae-hoe Koo, Suwon-si (KR); Se-young Yoon, Hwaseong-si (KR); Seung-jun Lee, Seoul (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 13/956,729

(22) Filed: Aug. 1, 2013

(65) Prior Publication Data

US 2014/0227640 A1 Aug. 14, 2014

(30) Foreign Application Priority Data

Feb. 13, 2013 (KR) ..... 10-2013-0015530

(51) Int. Cl.

| | |
|---|---|
| ***G03G 9/08*** | (2006.01) |
| ***G03G 9/093*** | (2006.01) |
| ***G03G 9/097*** | (2006.01) |

(52) U.S. Cl.

CPC ..... *G03G 9/09342* (2013.01); *G03G 9/09385* (2013.01); *G03G 9/09708* (2013.01); *G03G 9/09725* (2013.01)

(58) Field of Classification Search

CPC ..... G03G 9/09725
USPC ..... 430/108.6, 108.7, 110.2
See application file for complete search history.

(56) References Cited

U.S. PATENT DOCUMENTS

2009/0324296 A1* 12/2009 Joo et al. ..... 430/108.7

* cited by examiner

*Primary Examiner* — Mark A Chapman
(74) *Attorney, Agent, or Firm* — Staas & Halsey LLP

(57) ABSTRACT

Main performances of a toner are significantly affected by a shape and surface characteristics of toner particles. Using an external additive may be a factor that complicates control of surface characteristics of the toner particles, and anti-offset properties of toner change according to a wax and a binder composition at a surface portion of the toner particles. Provided is a toner usable in electrophotography, wherein the toner has improved durability, fixability, charging stability, and cleaning properties through an appropriate distribution of a binder, a wax, and an external additive on a surface portion of toner particles.

2 Claims, No Drawings

ELECTROPHOTOGRAPHY TONER

CROSS-REFERENCE TO RELATED APPLICATIONS

This application claims priority under 35 U.S.C. §119(a) from Korean Patent Application No. 10-2013-0015530, filed on Feb. 13, 2013, in the Korean Intellectual Property Office, the disclosure of which is incorporated herein in its entirety by reference.

BACKGROUND OF THE INVENTION

1. Field of the Invention

The present general inventive concept relates to a toner usable in electrophotography or electrostatic image development.

2. Description of the Related Art

It is difficult to provide precise control of the particle size and the geometric size distribution of toner by using a pulverizing process in the manufacturing method of toner suitable for an electrophotographic process or an electrostatic image recording process. Also, it is difficult to separately control the major characteristics of toner, such as charging characteristics, fixability, flowability, and preservation characteristics, by using a pulverizing process. In particular, toner needs to have a small particle size and a narrow geometric size distribution to obtain an image of high quality, but it is difficult to provide such toner by using a pulverizing process. Also, it is very difficult to control a toner particle internal structure to allow both a high gloss property and a large fixing area of toner by using a pulverizing process.

Alternatively, an aggregating process is suggested to solve the problems of a pulverizing process. In an aggregating process, binder resin latex particles, pigment particles, and wax particles are first prepared, and then toner particles are formed by aggregating the binder resin latex particles, pigment particles, and wax particles together. In an aggregating process, a shape and an internal structure of the toner particles are relatively easy to control, but controlling uniformity of a shape of the toner particles in relation to geometric size distribution of the toner particles is still difficult. That is, controlling a shape of the toner particles is facilitated when a particle size of the toner is greater than the average particle size, but a shape of the toner particles is closer to a sphere shape than a desired shape when a particle size of the toner is smaller than the average particle size. Toner particles of a sphere shape may cause degradation in cleaning performance of a cleaning blade during an electrophotography process.

In order to satisfy recent demands in printing such as high-speed printing, high-quality image printing, and environment friendly printing, toner having improved durability, improved fixability, or improved environmental properties is needed. Since a shearing stress is applied to the toner many times due to the high-speed printing, the toner needs to be designed to have a high durability. At the same time, the toner needs to be designed to have high gloss and a large fixing area to obtain a printing image of high quality. Such characteristics of the toner are expected to be significantly affected by a shape and surface characteristics of the toner particles.

Anti-offset properties of toner serve an important role by allowing the toner to have a large fixing area. Silicon oil may be coated on a fixing roller to improve the anti-offset properties of the toner. However, in this case, an oil tank and other related devices are needed. Also, degradation of the fixing roller is promoted, and thus frequent maintenance is necessary. Alternatively, a method of adding wax to toner is generally used to improve the anti-offset properties of the toner. The anti-offset properties of the toner are expected to change according to the wax and composition of a binder on a surface of the toner.

A method of adding an external additive including silica particles to a surface portion of the toner particles is used to improve charging stability, transferring efficiency, and cleaning properties. The external additive improves feeding characteristics of the toner by adding flowability to the toner particles. Also, the external additive may add charging stability to a surface portion of the toner particles. Moreover, the external additive may improve cleaning characteristics of the toner. That is, the external additive reduces adhesion force of the toner particles to a surface of an electrostatic latent image carrier, and thus remaining toner may be easily removed. However, using the external additive may be a factor that complicates control of surface characteristics of the toner particles.

SUMMARY OF THE INVENTION

The present general inventive concept provides a toner usable in electrophotography, wherein the toner has improved durability, fixability, charging stability, and cleaning properties through an appropriate distribution of a binder, a wax, and an external additive on a surface portion of toner particles.

The present general inventive concept also provides a toner to develop an electrostatic image.

According to exemplary embodiments of the present general inventive concept, main performances of a toner are significantly affected by a shape and surface characteristics of toner particles, using an external additive may be a factor that complicates control of surface characteristics of the toner particles, and anti-offset properties of toner change according to a wax and a binder composition at a surface portion of the toner particles.

Additional features and utilities of the present general inventive concept will be set forth in part in the description which follows and, in part, will be obvious from the description, or may be learned by practice of the general inventive concept.

Exemplary embodiments of the present general inventive concept provide a toner to develop an electrostatic image, the toner including core particles including a binder resin, a colorant, and a releasing agent, a shell layer that surrounds the core particles and includes a binder resin, and an external additive that is attached on a surface of the shell layer and includes silica particles and titanium dioxide particles. The core particles and the shell layer further include iron, the toner satisfying $0.7 \leq P_{2848}/P_{1493} \leq 1.10$ and $0.60 \leq TSI_{[Fe]}/TSI_{[C3H7]} \leq 1.10$, where $P_{2848}$ and $P_{1493}$ are each respectively peak intensities in a diffuse reflectance FT-IR spectrum of the toner at locations of 2848 $cm^{-1}$ and 1493 $cm^{-1}$, and $TSI_{[Fe]}$ and $TSI_{[C3H7]}$ are each respectively peak intensities in a TOF-SIMS spectrum of the toner corresponding to Fe and $C_3H_7$.

The toner may satisfy $0.1 \leq TSI_{[Si]}/TSI_{[Ti]} \leq 6.0$, wherein $TSI_{[Si]}$ and $TSI_{[Ti]}$ are each respectively peak intensities in a TOF-SIMS spectrum of the toner corresponding to Si and Ti.

Exemplary embodiments of the present general inventive concept also provide a toner to develop an electrostatic image, the toner including a plurality of toner particles, a ratio of a content of a releasing agent at a surface portion of the toner particles to a content of a first and second binder resin at the surface portion of the toner particles being in a range of about 0.7 to about 1.10, and a ratio of an iron content at the surface portion of the toner particles to the content of the first and second binder resin at the surface portion of the toner particles being in a range of about 0.6 to about 1.10, each toner particle including a core particle, a shell layer that surrounds the core particle, and an external additive that is attached on a surface of the shell layer, the core particle including the first binder resin, a colorant, the releasing agent, and iron, the shell including the second binder resin, and iron, and the external additive including silica particles and titanium dioxide particles.

The first and second binder resin may include one or more of the group consisting of: styrene resin, acrylic resin, vinyl resin, polyether polyol resin, phenol resin, silicon resin, polyester resin, epoxy resin, polyamide resin, polyurethane resin, and polybutadiene resin.

The styrene resin may include one or more of the group consisting of: polystyrene, homopolymer of styrene derivatives such as poly-p-chlorostyrene or polyvinyltoluene, styrene-based copolymer such as styrene-p-chlorostyrene copolymer, styrene-vinyltoluene copolymer, styrene-vinylnaphthalene copolymer, styrene-acrylic acid ester copolymer, styrene-methacrylic acid ester copolymer, styrene-α-chloromethacrylic acid methyl copolymer, styrene-acrylonitrile copolymer, styrene-vinylmethylether copolymer, styrene-vinylethylether copolymer, styrene-vinylmethylketone copolymer, styrene-butadiene copolymer, styrene-isoprene copolymer, and styrene-acrylonitrile-inden copolymer.

The acrylic resin may include one or more of the group consisting of: acrylic acid polymer, methacrylic acid polymer, methacrylic acid methylester polymer, and α-chloromethacrylic acid methylester polymer.

The vinyl resin may include one or more of the group consisting of: vinyl chloride polymer, ethylene polymer, propylene polymer, acrylonitrile polymer, and vinyl acetic acid polymer.

The first and second binder resin may be identical.

A number average molecular weight of the first binder resin may be in a range of about 700 to about 1,000,000.

The number average molecular weight of the first binder resin may be in a range of about 10,000 to about 200,000.

The colorant may include one or more of a black colorant, a yellow colorant, a magenta colorant, and a cyan colorant.

The yellow colorant may include one or more of the group consisting of: a condensed nitrogen compound, an isoindolinone compound, an anthraquine compound, an azo metal complex, an allyl imide compound, and C.I. Pigment Yellow 12, 13, 14, 17, 62, 74, 83, 93, 94, 95, 109, 110, 111, 128, 129, 147, 168, and 180.

The magenta colorant may include one or more of the group consisting of: a condensed nitrogen compound, an antraquine compound, a quinacridone compound, a base dye late compound, a naphthol compound, a benzo imidazole compound, a thioindigo compound, a pherylene compound, and C.I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254.

The cyan colorant may include one or more of the group consisting of: a copper phthalocyanine compound and a derivative thereof, an antraquine compound, a base dye late compound, and "C.I. Pigment Blue" 1, 7, 15, 15:1, 15:2, 15:3, 15:4, 60, 62, or 66.

The amount of the colorant contained in the core particles may be in the range of about 0.1 parts to about 20 parts by weight, based on 100 parts by weight of the first binder resin.

The amount of the colorant contained in the core particles may be in the range of about 2 parts to about 10 parts by weight based on 100 parts by weight of the first binder resin.

The releasing agent may include one or more of the group consisting of: a polyethylene-based wax, a polypropylene-based wax, a silicon-based wax, a paraffin-based wax, an ester-based wax, a carnauba-based wax, and a metallocene-based wax.

A melting point of the releasing agent may be in a range of about 50° C. to about 150° C.

An amount of the releasing agent in the core particles may be in the range of about 1 part to about 20 parts by weight based on 100 parts by weight of the first binder resin.

The amount of the releasing agent in the core particles may be in the range of about 1 part to about 10 parts by weight based on 100 parts by weight of the first binder resin.

A number average molecular weight of the second binder resin may be in a range of about 700 to about 1,000,000.

The number average molecular weight of the second binder resin may be in a range of about 10,000 to about 200,000.

The silica particles may include one or more of fumed silica and sol-gel silica.

A volume average particle size of the silica particles may be in the range of about 10 nm to about 80 nm.

The volume average particle size of the silica particles may be in the range of about 60 nm to about 80 nm.

The silica particles may include first silica particles having a volume average particle size in a range of about 30 nm to about 100 nm, and second silica particles having a volume average particle size in a range of about 5 nm to about 20 nm.

A weight ratio of the first silica particles to the second silica particles may be in a range of about 0.5:1.5 to about 1.5:0.5.

The silica particles may include a sol-gel silica having a number average aspect ratio in a range of about 0.83 to about 0.97.

The titanium dioxide particles comprise at least one of anatase titanium dioxide having an anatase crystal structure and rutile titanium dioxide having a rutile crystal structure.

The silica particles and the titanium dioxide particles may be hydrophobically treated with at least one of a silicone oil, a silane, a siloxane, and a silazane.

The silica particles and the titanium dioxide particles may each have a degree of hydrophobicity in a range of about 10 to about 90.

The iron of the core particles and the shell layer may include an iron-containing aggregation agent.

The iron-containing aggregation agent may include polysilica iron.

DETAILED DESCRIPTION OF THE PREFERRED EMBODIMENTS

Reference will now be made in detail to the embodiments of the present general inventive concept. The embodiments are described below in order to explain the present general inventive concept.

When an amount of a releasing agent distribution on a surface portion of toner particles having a core-shell structure increases, flowability, charging characteristics, and durability of a toner may be deteriorated. On the other hand, when a releasing agent is distributed only in the toner particles and not on the surface portion of the toner particles having a core-shell structure, the releasing agent may not work as a releasing agent, and thus anti-offset characteristic at high temperatures or gloss properties of the toner may be deteriorated. Therefore, a binder resin and a releasing agent need to be distributed on the surface portion of the toner particles at an appropriate composition to improve durability and fixability of the toner.

A silica powder as an external additive enhances flowability and charging characteristics of a toner. However, when too many silica particles are on a surface portion of toner particles, the silica particles may be separated from the toner particles or the silica particles may be buried into the toner particles due to a shearing force. Accordingly, durability of the toner may be deteriorated, and thus an image may be contaminated. Additionally, when only the silica powder is used as an external additive, a charge-up phenomenon may occur. When the charge-up phenomenon occurs in the toner, an amount of the toner adhering to a developing roller increases, and thus a height of a toner layer formed on the developing roller may increase. A titanium dioxide powder as an external additive in addition to the silica powder serves to prevent such a charge-up phenomenon. Also, the titanium dioxide powder may reduce a deviation of a toner charging amount according to environments with high temperature and high humidity or environments with low temperature and low humidity. Thus, the silica powder and the titanium oxide powder may be distributed on the surface portion of the toner particles at an appropriate composition.

According to an exemplary embodiment of the present general inventive concept, Condition 1 is: $0.7 \leq P_{2848}/P_{1493} \leq 1.10$. Here, $P_{2848}$ and $P_{1493}$ respectively denote the peak intensities in a diffuse reflectance FT-IR spectrum of the toner at locations of 2848 $cm^{-1}$ and 1493 $cm^{-1}$. $P_{2848}$ may be only detected from a releasing agent, and $P_{1493}$ may be only detected from a binder. Accordingly, $P_{2848}$ represents a content of the releasing agent at the surface portion of the toner particles, and $P_{1493}$ represents a content of the binder resin at the surface portion of the toner particles. In this regard, $P_{2848}/P_{1493}$ represents a ratio of the content of the releasing agent to the content of the binder resin at the surface portion of the toner particles. Here, $P_{2848}$ and $P_{1493}$, and accordingly $P_{2848}/P_{1493}$, show a composition of "the surface portion" of the toner particles. Here, an overall composition of the toner particles may be different from a composition of the surface portion of the toner particles.

When $P_{2848}/P_{1493}$ is less than 0.7, a content of the releasing agent on the surface portion of the toner particles may be insufficient. Thereby, an off-set phenomenon may occur, and thus a deficiency may occur on a fixed image. When $P_{2848}/P_{1493}$ is greater than 1.10, the releasing agent on the surface portion of the toner particles may be exposed too much. Thereby, durability of the toner may decrease and a developing roller filming phenomenon may occur, and thus an image may be contaminated.

According to the current exemplary embodiment of the present general inventive concept, Condition 2 is: $0.60 \leq TSI_{[Fe]}/TSI_{[C3H7]} \leq 1.10$. Here, $TSI_{[Fe]}$ and $TSI_{[C3H7]}$ respectively denote intensities of peaks in a TOF-SIMS spectrum of the toner corresponding to Fe and $C_3H_7$. $TSI_{[Fe]}$ represents a content of Fe on the surface portion of the toner particles. $TSI_{[C3H7]}$ represents a content of a binder resin on the surface portion of the toner particles. Accordingly, $TSI_{[Fe]}/TSI_{[C3H7]}$ represents a ratio of the content of Fe to the content of the binder resin on the surface portion of the toner particles. Here, $TSI_{[Fe]}$ and $TSI_{[C3H7]}$, and accordingly $TSI_{[Fe]}/TSI_{[C3H7]}$, show a composition of "the surface portion" of the toner particles, which may be distinct from an overall composition of the toner particles.

When $TSI_{[Fe]}/TSI_{[C3H7]}$ is less than 0.60, durability of the toner is degraded, and thus an image may be contaminated. When $TSI_{[Fe]}/TSI_{[C3H7]}$ is greater than 1.10, a melt viscosity of the toner increases, and thus a minimum fusing temperature (MFT) may increase. Also, stably controlling a charging performance of the toner may be difficult.

A toner according to an exemplary embodiment of the present general inventive concept may have improved performances in all areas such as flowability, life durability, a developing roller filming, MFT, HOT, image contamination, and transferring properties by satisfying both Conditions 1 and 2.

According to an exemplary embodiment of the present general inventive concept, Condition 3 is: $0.1\ TSI_{[Si]}/TSI_{[Ti]} \leq 6.0$. Here, $TSI_{[Si]}$ and $TSI_{[Ti]}$ respectively denote intensities of peaks in a TOF-SIMS spectrum of the toner corresponding to Si and Ti. $TSI_{[Si]}$ represents a content of a silica powder on the surface portion of the toner particles. $TSI_{[Ti]}$ represents a content of a titanium dioxide powder on the surface portion of the toner particles. Accordingly, $TSI_{[Si]}/TSI_{[Ti]}$ represents a ratio of the content of silica powder to the content of the titanium dioxide powder on the surface portion of the toner particles. Here, $TSI_{[Si]}$ and $TSI_{[Ti]}$, and accordingly $TSI_{[Si]}/TSI_{[Ti]}$, show a composition of "the surface portion" of the toner particles, which may be distinct from an overall composition of the toner particles.

When $TSI_{[Si]}/TSI_{[Ti]}$ is less than 0.1, a charging performance of the toner is degraded, and thus a photoreceptor background contamination phenomenon may occur. When $TSI_{[Si]}/TSI_{[Ti]}$ is greater than 6.0, a charging uniformity of the toner may be deteriorated, and as an adhesive force between the toner and the photoreceptor increases, a transferring performance of the toner may be deteriorated.

A toner according to an exemplary embodiment of the present general inventive concept may have further improved performances in all areas such as flowability, life durability, a developing roller filming, MFT, HOT, image contamination, and transferring properties by satisfying all of Conditions 1 to 3.

The toner particle includes a core particle including a binder resin, a colorant, and a releasing agent.

The binder resin of the core particle may be, for example, styrene resin, acrylic resin, vinyl resin, polyether polyol resin, phenol resin, silicon resin, polyester resin, epoxy resin, polyamide resin, polyurethane resin, polybutadiene resin, or a mixture thereof.

The styrene resin may be, for example, polystyrene, homopolymer of styrene derivatives such as poly-p-chlorostyrene or polyvinyltoluene, styrene-based copolymer such as styrene-p-chlorostyrene copolymer, styrene-vinyltoluene copolymer, styrene-vinylnaphthalene copolymer, styrene-acrylic acid ester copolymer, styrene-methacrylic acid ester copolymer, styrene-α-chloromethacrylic acid methyl copolymer, styrene-acrylonitrile copolymer, styrene-vinylmethylether copolymer, styrene-vinylethylether copolymer, styrene-vinylmethylketone copolymer, styrene-butadiene copolymer, styrene-isoprene copolymer, or styrene-acrylonitrile-inden copolymer, or a mixture thereof.

The acrylic resin may be, for example, acrylic acid polymer, methacrylic acid polymer, methacrylic acid methylester polymer, α-chloromethacrylic acid methylester polymer, or a mixture thereof.

The vinyl resin may be, for example, vinyl chloride polymer, ethylene polymer, propylene polymer, acrylonitrile polymer, vinyl acetic acid polymer, or a mixture thereof.

A number average molecular weight of the binder resin in the core particle may be, for example, in a range of about 700 to about 1,000,000, or about 10,000 to about 200,000.

The colorant may be, for example, black colorant, yellow colorant, magenta colorant, cyan colorant, or a combination thereof.

The black colorant may be, for example, carbon black, aniline black, or a mixture thereof.

The yellow colorant may be, for example, a condensed nitrogen compound, an isoindolinone compound, an anthraquine compound, an azo metal complex, an allyl imide compound, or a mixture thereof. Also, "C.I. Pigment Yellow" 12, 13, 14, 17, 62, 74, 83, 93, 94, 95, 109, 110, 111, 128, 129, 147, 168, or 180 may be more particular examples of the yellow colorant.

The magenta colorant may be, for example, a condensed nitrogen compound, an antraquine compound, a quinacridone compound, a base dye late compound, a naphthol compound, a benzo imidazole compound, a thioindigo compound, and a pherylene compound, or a mixture thereof. Also, "C.I. Pigment Red" 2, 3, 5, 6, 7, 23, 48:2, 48:3, 48:4, 57:1, 81:1, 122, 144, 146, 166, 169, 177, 184, 185, 202, 206, 220, 221, or 254 may be more particular examples of the magenta colorant.

The cyan colorant may be, for example, a copper phthalocyanine compound and a derivative thereof, and an antraquine compound, a base dye late compound, or a mixture thereof. Also, "C.I. Pigment Blue" 1, 7, 15, 15:1, 15:2, 15:3, 15:4, 60, 62, or 66 may be more particular examples of the cyan colorant.

An amount of the colorant contained in the core particles may be in a range of, for example, about 0.1 parts to about 20 parts by weight, or about 2 parts to about 10 parts by weight based on 100 parts by weight of the binder resin.

The releasing agent may be, for example, a polyethylene-based wax, a polypropylene-based wax, a silicon-based wax, a paraffin-based wax, an ester-based wax, a carnauba-based wax, a metallocene-based wax, or a mixture thereof.

The releasing agent may have a melting point in a range of, for example, about 50° C. to about 150° C.

An amount of the releasing agent in the core particles may be in a range of, for example, from about 1 part to about 20 parts by weight or from about 1 part to about 10 parts by weight based on 100 parts by weight of the binder resin.

A shell layer surrounds the core particles. The shell layer includes a binder resin. The binder resin of the shell layer may be, for example, styrene resin, acrylic resin, vinyl resin, polyether polyol resin, phenol resin, silicon resin, polyester resin, epoxy resin, polyamide resin, polyurethane resin, polybutadiene resin, or a mixture thereof. The styrene resin may be, for example, polystyrene, homopolymer of styrene derivatives such as poly-p-chlorostyrene or polyvinyltoluene, styrene-based copolymer such as styrene-p-chlorostyrene copolymer, styrene-vinyltoluene copolymer, styrene-vinylnaphthalene copolymer, styrene-acrylic acid ester copolymer, styrene-methacrylic acid ester copolymer, styrene-α-chloromethacrylic acid methyl copolymer, styrene-acrylonitrile copolymer, styrene-vinylmethylether copolymer, styrene-vinylethylether copolymer, styrene-vinylmethylketone copolymer, styrene-butadiene copolymer, styrene-isoprene copolymer, or styrene-acrylonitrile-inden copolymer, or a mixture thereof. The acrylic resin may be, for example, acrylic acid polymer, methacrylic acid polymer, methacrylic acid methylester polymer, α-chloromethacrylic acid methylester polymer, or a mixture thereof. The vinyl resin may be, for example, vinyl chloride polymer, ethylene polymer, propylene polymer, acrylonitrile polymer, vinyl acetate polymer, or a mixture thereof. A number average molecular weight of the binder resin of the shell layer may be, for example, in a range of about 700 to about 1,000,000, for example, in a range of about 10,000 to about 200,000. The binder resin of the shell layer and the binder resin of the core particle may be the same or different from each other.

The external additive includes silica particles and titanium-containing particles.

The silica particles may be, for example, fumed silica, sol-gel silica, or a mixture thereof.

If a primary particle size of the silica particles is too large, the externally added toner particles may be relatively difficult to pass through a developing blade. Accordingly, a selection phenomenon may occur. That is, as only the relatively smaller toner particles pass through the developing blade, an operation time of the toner cartridge increases, and a particle size of the toner particles remaining in the toner cartridge gradually increases. As a result, a quantity of charge decreases, and thus a thickness of a toner layer to develop an electrostatic latent image increases. Also, if a primary particle size of the silica particles is too large, a probability of the silica particles to be separated from the core particles (for example, due to stress which is applied to the toner particle by a member such as a feed roller) may relatively increase. The separated silica particles may contaminate the charging member or the latent image carrier. On the other hand, if a primary particle size of the silica particles is too small, the silica particles are apt to be embedded into the core particles due to shearing stress of a developing blade that is induced on a toner. If the silica particles are embedded into the core particles, the silica particles lose a function as an external additive, and thus adhesion between the toner particles and a surface of photoreceptor (OPC) may be undesirably increased. Consequently, cleaning ability and transferability of the toner decrease. A volume average particle size of the silica particles may be in a range of, for example, about 10 nm to about 80 nm, about 30 nm to about 80 nm, or about 60 nm to about 80 nm.

A toner according to another exemplary embodiment of the present general inventive concept may include silica particles with a large diameter of a volume average particle size in a range of about 30 nm to about 100 nm and silica particles with a small diameter of a volume average particle size in a range of about 5 nm to about 20 nm. The silica particles with a small diameter provide a larger surface area than the silica particles with a large diameter and serve to further improve charge stability of toner particles. Also, the silica particles with a small diameter are attached to core particles while they are disposed between the silica particles with a large diameter. Thus, even when the shearing stress is induced to the toner from the outside, the shearing stress is not conveyed to the silica particles with a small diameter. That is, the shearing stress induced to the toner from the outside is focused on the silica particles with a large diameter. Accordingly, the silica particles with a small diameter are not embedded into the core particles, and thus the improved charge stability may be maintained. If a content of the silica particles with a small diameter compared to the silica particles with a large diameter is too low, durability of the toner drops, and charge stability may be insignificantly improved. If a content of the silica particles with a small diameter compared to the silica particles with a large diameter is too high, contamination may be caused by cleaning deterioration of a charging member or latent image carrier. A weight ratio of the silica particles with a large diameter to the silica particles with a small diameter may be, for example, from about 0.5:1.5 to about 1.5:0.5.

According to another exemplary embodiment of the present general inventive concept, silica particles in a toner may include a sol-gel silica with a number average aspect ratio from about 0.83 to about 0.97. Here, an aspect ratio refers to a ratio of a minimum diameter to a maximum diameter of sol-gel silica particles. A number average aspect ratio of the sol-gel silica particles in the current exemplary embodiment of the general inventive concept may be measured as follows. First, a plane image of toner particles that are externally added with the sol-gel particles that is 50,000 times magnified using a scanning electron microscopy (SEM) is obtained. Next, an aspect ratio of each of the sol-gel silica particles is obtained by measuring a minimum diameter and a maximum diameter of each of the sol-gel silica particles shown in the plane image with an image analyzer. Then, the sum of the aspect ratios of the sol-gel silica particles is divided by a number of the sol-gel silica particles to define a value of the number average aspect ratio of the sol-gel silica particles. Here, the number of the sol-gel silica particles included in the calculation of the number average aspect ratio is fixed to be 50. According to the current exemplary embodiment of the present general inventive concept, cleaning ability of a toner may be more significantly increased when sol-gel particles having a number average aspect ratio in a range of about 0.83 to about 0.97 are used as an external additive. An increase in cleaning ability of a toner indicates that adhesion between toner particles and a surface of an OPC is appropriately decreased. If the cleaning ability of a toner is increased during electrophotographic processes, untransferred toner remaining on the OPC after a transferring step may be removed almost completely by a cleaning blade. Accordingly, contamination of a charge roller due to untransferred toner may be suppressed. Also, a filming phenomenon on a surface of an OPC due to an untransferred toner may be suppressed. Also, if an external additive remains untransferred on the OPC, the external additive may pass through a niche between the cleaning blade and the OPC since the external additive is nano-sized. In particular, if particles of the external additive are spherical, rotation of the particles may be easy, and thus the particles may pass the cleaning blade easily. The external additive which passed the cleaning blade may contaminate the charge roller. Therefore, when an aspect ratio of silica is reduced to make it difficult for the particles of the external additive to pass the cleaning blade, cleaning ability of the external additive also improves.

Sol-gel silica particles may be obtained by, for example, removing a solvent from a sol-gel suspension that is produced by hydrolyzing and condensing alkoxy silane in an organic solvent in which water is present.

An example of the titanium-containing particles is titanium dioxide, but is not limited thereto. Examples of titanium dioxide particles may be anatase titanium dioxide having an anatase crystal structure and rutile titanium dioxide having a rutile crystal structure. Titanium dioxide having a rutile crystal structure is used as an external additive of the toner because if only silica with a strong negative chargeability is externally added to a surface of the toner, a charge-up phenomenon may easily occur. Particularly, in a contact type development system, a quantity of the toner attached on a developing roller increases, and thus the thickness of the toner layer may be increased. In a non-contact type development system, if titanium oxide is not used, a quantity of charge is high, and thus image concentration is low since developing ability is decreased. Therefore, a charge deviation is reduced and charge-up is improved under high-temperature and high-humidity conditions or low-temperature and low-humidity conditions by adding titanium oxide to stabilize a rapid change in charge which is caused when only silica is externally added. However, if titanium oxide is overused, background contamination may occur. Thus, an appropriated ratio of silica with a strong negative chargeability and titanium oxide with a low negative chargeability may be one of the most important factors that may affect an electrophotographic system such as durability and other image contamination as well as a quantity of charge.

The silica particles and the titanium dioxide particles may be hydrophobically treated with, for example, silicone oils, silanes, siloxanes, or silazanes. A degree of hydrophobicity of each of the silica particles and the titanium dioxide particles may be in a range of about 10 to about 90. The degree of hydrophobicity refers to a value measured by using a methanol titration method known in the art. For example, the degree of hydrophobicity may be measured as follows. To a glass beaker with an internal diameter of 7 cm, a capacity of 2000 ml or more, and containing 100 ml of ion exchange water is added 0.2 g of silica particles or titanium dioxide particles to be measured for the degree of hydrophobicity, and is stirred with a magnetic stirrer. A tip part of a burette containing methanol is immersed in the suspension, into which 2 l of methanol is dripped while being stirred, the stirring is stopped after 30 seconds, and 1 minute after stopping the stirring the state of the suspension is observed. This operation is repeatedly performed. When the silica particles do not float on the water surface 1 minute after stopping the stirring, the total added amount of methanol is taken as Y (ml) and a value obtained by the following formula is calculated as the degree of hydrophobicity. The water temperature in the beaker is adjusted to 20° C.±1° C. to perform the measurement. The degree of hydrophobicity=[Y/(100+Y)]×100.

For the toner according to the current exemplary embodiment of the present general inventive concept, the core particles and the shell layer are manufactured by using an aggregating process using an iron-containing aggregating agent. In this regard, the core particles and the shell layer further include iron. Alternatively, the core particles and the shell layer may contain iron in a form of an iron-containing aggregation agent. The iron-containing aggregation agent may be, for example, polysilica iron.

EXAMPLES

Preparation Example 1

Preparation of Low-Molecular Weight Binder Resin Latex

A polymerizable monomer mixture (825 g of styrene and 175 g of n-butyl acrylate), 30 g of β-carboxyethylacrylate, 17 g of 1-dodecanethiol as a chain transfer agent (CTA), and 418 g of a 2 wt % aqueous solution of sodium dodecyl sulfate as an emulsifier were loaded into a 3 L beaker, and the mixture was stirred to prepare a polymerizable monomer emulsion. Separately, 16 g of ammonium persulfate (APS) as an initiator and 696 g of 0.4 wt % aqueous solution of sodium dodecyl sulfate as an emulsifier were loaded into a 3 L double-jacketed reactor heated to a temperature of 75° C., and the polymerizable monomer emulsion separately prepared as described above was slowly added thereto dropwise for 2 hours while stirring to initiate a polymerizing reaction. The polymerizing reaction was continued at 75° C. for 8 hours to prepare binder resin latex particles. A particle size of the binder resin latex particles was measured using a light scattering type particle size analyzer (Microtrac), and the measured particle size was from 180 nm to 250 nm. A solid content of the latex measured by using a loss-on-drying method was 42 wt %. A weight average molecular weight Mw of the latex measured using a gel permeation chromatography (GPC) method on a tetrahydrofuran (THF) soluble fraction was 25,000 g/mol. A glass transition temperature of the latex was measured by using a differential scanning calorimeter (DSC: available from PerkinElmer) in a second scan at a heating rate of 10° C./min was 62° C.

Preparation Example 2

Preparation of High-Molecular Weight Binder Resin Latex

A polymerizable monomer mixture (685 g of styrene and 315 g of n-butyl acrylate), 30 g of β-carboxyethylacrylate, and 418 g of a 2 wt % aqueous solution of sodium dodecyl sulfate as an emulsifier were loaded into a 3 L beaker, and the mixture was stirred to prepare a polymerizable monomer emulsion. Separately, 5 g of ammonium persulfate (APS) as an initiator and 696 g of 0.4 wt % aqueous solution of sodium dodecyl sulfate as an emulsifier were loaded into a 3 L double-jacketed reactor heated to a temperature of 60° C., and the polymerizable monomer emulsion separately prepared as described above was slowly added thereto dropwise for 3 hours while stirring to initiate a polymerizing reaction. The polymerizing reaction was continued at 75° C. for 8 hours to prepare binder resin latex particles. A particle size of the binder resin latex particles was measured using a light scattering type particle size analyzer (Horiba 910), and the measured particle size was from 180 nm to 250 nm. A solid content of the latex measured by using a loss-on-drying method was 42 wt %. A weight average molecular weight Mw of the latex measured using a gel permeation chromatography (GPC) method on a tetrahydrofuran (THF) soluble fraction was 250,000 g/mol. A glass transition temperature of the latex was measured by using a differential scanning calorimeter (DSC: available from PerkinElmer) in a second scan at a heating rate of 10° C./min was 53° C.

Preparation Example 3

Preparation of Magenta Colorant Dispersion 10 g of sodium dodecyl sulfate as an anionic reactive emulsifier and 60 g of magenta pigment colorant (PR122) were loaded into a milling bath, and 400 g of glass beads having a diameter of 0.8 mm to 1 mm were added thereto and milling was performed thereon at room temperature to prepare a colorant dispersion. A colorant particle size of the colorant dispersion diameter was measured using a light scattering type particle size analyzer (Horiba 910), and the measured colorant particle size was 180 nm to 200 nm. A solid content of the prepared colorant dispersion was 18.5 wt %.

Preparation Example 4

Preparation of Wax Dispersion 300 g of deionized water, 10 g of sodium dodecyl sulfate as an anionic reactive emulsifier, and 90 g of Carnauba Wax no. 1 (Japan Oil Co.) were loaded into reactor, stirred at a temperature of 90° C. and a rate of 14,000 rpm for 20 minutes by using a homogenizer to prepare a wax dispersion. A wax particle size of the wax dispersion was measured using a light scattering type particle size analyzer (Horiba 910), and the measured particle size was 250 nm to 300 nm. A solid content of the prepared wax dispersion was 30 wt %.

Example 1

Preparation of Externally Added Aggregation Toner 3000 g of deionized water, 1137 g of a binder resin latex mixture as the core particle (a mixture of 91.5 wt % of the low-molecular weight latex prepared in Preparation Example 1 and 8.5 wt % of the high-molecular weight latex prepared in Preparation Example 2), 195 g of the colorant dispersion prepared in Preparation Example 3, and 237 g of the wax dispersion prepared in Preparation Example 4 were loaded into a 7 L reactor to obtain a first mixture. Then, an aggregation agent solution (a mixture of 364 g of 0.3 M nitric acid aqueous solution and 182 g of polysilica iron) was added to the first mixture and stirred at a rate of 11,000 rpm for 6 minutes by using a homogenizer to obtain a third mixture containing an aggregated particles having a particle size of 1.5 μm to 2.5 μm. The third mixture was loaded into a 7 L double-jacketed reactor heated from room temperature to a temperature of 55° C. (−5° C. from a Tg of latex) at a rate of 0.5° C. per minute. When a particle size of the aggregated particles (core particles) in the third mixtures became 6.0 μm, 442 g of a binder resin latex as the shell layer (a mixture of 90 wt % of the low-molecular weight latex prepared in Preparation Example 1 and 10 wt % of the high-molecular weight latex prepared in Preparation Example 2) was slowly added thereto for 20 minutes to obtain a fourth mixture. Then, when a volume average particle size D50 of the aggregated particles in the fourth mixture became 6.8 μm, 1 M NaOH aqueous solution was added thereto to adjust pH of the fourth mixture to 7. When a value of the volume average particle size D50 of the aggregation in the fourth mixture was constantly maintained for 10 minutes, a temperature of the fourth mixture was increased to 96° C. When a temperature reached 96° C., pH was adjusted to 6.0, and the aggregated particle in the fourth mixture was unified for 5 hours. As a result, aggregated toner particles having a potato shape at a size of 6.5 μm to 7.0 μm were obtained. Then, the fourth mixture was cooled and filtered to separate the aggregated toner particles. The separated aggregated toner particles were dried. Therefore, toner particles having a core-shell structure were obtained. 2.0 parts by weight of a sol-gel silica powder (SG50, available from Sukgyung AT Co. Ltd.), 0.5 parts by weight of a titanium dioxide powder (SGT50, available from Sukgyung AT Co. Ltd.), and 0.5 parts by weight of a titanium strontium oxide ($SrTiO_3$, with an average particle size of 100 nm) were added to 100 parts by weight of the dried toner particles and stirred by using a mixer (KM-LS2K, available from Dae Wha Tech, Korea) at a rate of 8,000 rpm for 4 minutes to obtain externally added toner particles. A volume average diameter of the externally added toner particles was 7.0 μm. GSDp and GSDv values of the externally added toner were each respectively 1.282 and 1.217. Also, an average sphericity of the externally added toner was 0.971.

Example 2

Preparation of Externally Added Aggregation Toner 3000 g of deionized water, 1137 g of a binder resin latex mixture as the core particle (a mixture of 91.5 wt % of the low-molecular weight latex prepared in Preparation Example 1 and 8.5 wt % of the high-molecular weight latex prepared in Preparation Example 2), 195 g of the colorant dispersion prepared in Preparation Example 3, and 237 g of the wax dispersion prepared in Preparation Example 4 were loaded into a 7 L reactor to obtain a first mixture. Then, an aggregation agent solution (a mixture of 364 g of 0.3 M nitric acid aqueous solution and 182 g of polysilica iron) was added to the first mixture and stirred at a rate of 11,000 rpm for 6 minutes by using a homogenizer to obtain a third mixture containing aggregated particles having a particle size of 1.5 μm to 2.5 μm. The third mixture was loaded into a 7 L double-jacketed reactor heated from room temperature to a temperature of 55° C. (−5° C. from a Tg of latex) at a rate of 0.5° C. per minute. When a particle size of the aggregated particles (core particles) in the third mixtures became 6.0 μm, 442 g of a binder resin latex as the shell layer (a mixture of 90 wt % of the low-molecular weight latex prepared in Preparation Example 1 and 10 wt % of the high-molecular weight latex prepared in Preparation Example 2) was slowly added thereto for 20 minutes to obtain a fourth mixture. Then, when a volume average particle size D50 of the aggregated particles in the fourth mixture became 6.8 μm, 1 M NaOH aqueous solution was added thereto to adjust pH of the fourth mixture to 7. When a value of the volume average particle size D50 of the aggregation in the fourth mixture was constantly maintained for 10 minutes, a temperature of the fourth mixture was increased to 96° C. When a temperature reached 96° C., pH was adjusted to 5.5, and the aggregated particle in the fourth mixture was unified for 5 hours. As a result, aggregated toner particles having a potato shape at a size of 6.5 μm to 7.0 μm was obtained. Then, the fourth mixture was cooled and filtered to separate the aggregated toner particles. The separated aggregated toner particles were dried. Therefore, toner particles having a core-shell structure were obtained. 2.0 parts by weight of a sol-gel silica powder (SG50, available from Sukgyung AT Co. Ltd.), 0.5 parts by weight of a titanium dioxide powder (SGT50, available from Sukgyung AT Co. Ltd.), and 0.5 parts by weight of a titanium strontium oxide ($SrTiO_3$, with an average particle size of 100 nm) were added to 100 parts by weight of the dried toner particles and stirred by using a mixer (KM-LS2K, available from Dae Wha Tech, Korea) at a rate of 8,000 rpm for 4 minutes to obtain externally added toner particles. A volume average diameter of the externally added toner particles was 7.0 μm. GSDp and GSDv values of the externally added toner were each respectively 1.282 and 1.217. Also, an average sphericity of the externally added toner was 0.971.

Example 3

Preparation of Externally Added Aggregation Toner

An externally added toner was prepared in the same manner as in Example 1, except that 118 g of the wax dispersion prepared in Example 4 was used.

Comparative Example 1

An externally added toner was prepared in the same manner as in Example 1, except that latex for forming a shell layer was not added. First, 3000 g of deionized water, 1137 g of a binder resin latex mixture as the core particle (a mixture of 91.5 wt % of the low-molecular weight latex prepared in Preparation Example 1 and 8.5 wt % of the high-molecular weight latex prepared in Preparation Example 2), 195 g of the colorant dispersion prepared in Preparation Example 3, and 237 g of the wax dispersion prepared in Preparation Example 4 were loaded into a 7 L reactor to obtain a first mixture. Then, an aggregation agent solution (a mixture of 364 g of 0.3 M nitric acid aqueous solution and 182 g of polysilica iron) was added to the first mixture and stirred at a rate of 11,000 rpm for 6 minutes by using a homogenizer to obtain a third mixture containing aggregated particles having a particle size of 1.5 μm to 2.5 μm. The third mixture was loaded into a 7 L double-jacketed reactor heated from room temperature to a temperature of 55° C. (−5° C. from a Tg of latex) at a rate of 0.5° C. per minute. When a particle size of the aggregated particles (core particles) in the third mixtures became 6.8 μm, 1 M NaOH aqueous solution was added thereto to adjust pH of the third mixture to 7. When a value of the volume average particle size D50 of the aggregation in the third mixture was constantly maintained for 10 minutes, a temperature of the third mixture was increased to 96° C. When a temperature reached 96° C., pH was adjusted to 6.0, and the aggregated particle in the third mixture was unified for 5 hours. As a result, aggregated toner particles having a potato shape at a size of 6.5 μm to 7.0 μm was obtained. Then, the third mixture was cooled and filtered to separate the aggregated toner particles. Then, the third mixture was cooled and filtered to separate the aggregated toner particles. The separated aggregated toner particles were dried. Therefore, toner particles having no shell were obtained. 2.0 parts by weight of a sol-gel silica powder (SG50, available from Sukgyung AT Co. Ltd.), 0.5 parts by weight of a titanium dioxide powder (SGT50, available from Sukgyung AT Co. Ltd.), and 0.5 parts by weight of a titanium strontium oxide ($SrTiO_3$, with an average particle size of 100 nm) were added to 100 parts by weight of the dried toner particles and stirred by using a mixer (KM-LS2K, available from Dae Wha Tech, Korea) at a rate of 8,000 rpm for 4 minutes to obtain externally added toner particles.

Comparative Example 2

An externally added toner was prepared in the same manner as in Example 1, except that the wax dispersion prepared in Example 4 was not added.

Comparative Example 3

An externally added toner was prepared in the same manner as in Example 1, except that polyaluminium chloride (PAC) was used instead of polysilica iron.

Comparative Example 4

An externally added toner was prepared in the same manner as in Example 1, except that an amount of titanium oxide added in the externally adding process was 0.05 parts by weight instead of 0.5 parts by weight.

<Analysis of Surfaces of Toner Particles>

Diffuse Reflectance IR Spectroscopy

An IR spectroscopy Nicolet 380 available from Thermo Scientific in U.S and a diffuse reflectance accessory available from Pike Technology in U.S. were used.

A ratio of $P_{2848}/P_{1493}$ was calculated by using peak intensities of $P_{2848}$ and $P_{1493}$ each respectively detected at wave numbers of 2848 $cm^{-1}$ and 1493 $cm^{-1}$ corresponding to a wax and a binder.

Time-of-Flight Secondary Ion Mass Spectrometry (TOF/SIMS)

TOFSIMS 5 available from ION TOF in Germany was used. (Analysis conditions: Primary Beam Bi1, Polarity=positive, area=50*50 um2, time=60 s, Current=1 Pa)

Ratios of $TSI_{[Fe]}/TSI_{[C7H7]}$ and $TSI_{[Si]}/TSI_{[Ti]}$ were calculated by using peak intensities $TSI_{[Fe]}$, $TSI_{[Si]}$, $TSI_{[Ti]}$, and $TSI_{[C7H7]}$ of a mass spectrum of Fe, Si, Ti, and $C_7H_7$ each respectively correspond to an aggregating agent, an external additive, and a binder resin.

<Evaluation of Toner Performance>

In order to evaluate the characteristics of the externally added toners prepared in Examples 1 to 3 and Comparative Examples 1 to 4, tests were performed in the following manner. First, the cohesiveness was measured to evaluate the flowability of the obtained toners. Image evaluation was performed by printing an image with 1% coverage up to 5,000 sheets by using a non-magnetic monocomponent developing type printer (CLP-620, available from Samsung Electronics Co., Ltd, tandem system, 20 ppm, constructed of non-contact type developing devices) and the toners prepared in Examples 1 to 3 and Comparative Examples 1 to 4 and by measuring developing properties, transferring properties, image concentration, image contamination, and variations over time (variations in toner layers and image concentration on a developing roller according to the number of sheets printed) according to printing environment conditions in the following manner, and the results are shown in Table 1 below.

Cohesiveness (Toner Flowability)

Equipment: Hosokawa micron powder tester PT-S

Amount of sample: 2 g

Amplitude: 1 mm dial 3 to 3.5

Sieve: 53, 45, 38 μm

Vibration time: 120±0.1 seconds

After the samples were stored at room temperature and RH of 55±5% for 2 hours, the samples were sieved under the above conditions to calculate the cohesiveness of toner as follows.

$$[(\text{mass of powders remaining on 53 μm sieve})/2\ g]\times 100 \quad (1)$$

$$[(\text{mass of powders remaining on 45 μm sieve})/2\ g]\times 100\times(3/5) \quad (2)$$

$$[(\text{mass of powders remaining on 38 μm sieve})/2\ g]\times 100\times(1/5) \quad (3)$$

$$\text{Degree of cohesiveness(Carr's cohesion)}=(1)+(2)+(3)$$

The calculated cohesiveness was classified according to the following standard:

○: a degree of cohesiveness 15: Satisfactory flowability

Δ: 15<a degree of cohesiveness 20: Inferior flowability x: 20<a degree of cohesiveness: Vastly inferior flowability Life Durability (Variations Over Time)

When 5,000 sheets were printed, a weight of toner per unit area on a developing roller was measured to evaluate a degree of variation relative to the initial phase as the number of sheets to be printed increased. The measurement results were classified according to the following standard.

○: An increased weight of a toner per unit area on a developing roller from an initial weight of the toner after printing 5,000 sheets<20%

Δ: 20%≤An increased weight of a toner per unit area on a developing roller from an initial weight of the toner after printing 5,000 sheets<30% x: 30%≤An increased weight of a toner per unit area on a developing roller from an initial weight of the toner after printing 5,000 sheets Fixability of Toner After printing 50 sheets of an image by using a printer (CLP-620, available from Samsung Electronics Co., Ltd, tandem system, 20 ppm), a fixability of the fixed image was evaluated in the following manner. An optical density (OD) of the fixed image was measured, and then 3M 810 tape was attached on the image portion. On the image attached with the tape, a 500 g weight was moved back and forth for five times, and then the tape was peeled. Then, OD after peeling the tape was measured again.

$$\text{fixability}(\%)=(\text{OD_after tape peeling}/\text{OD_before tape peeling})\times 100$$

Average OD values for 3 sheets were used.

Minimum Fixing Temperature (MFT)

Measurement temperature: A temperature was measured at an interval of 5° C. while changing a temperature from 155° C. to 210° C.

Used paper: Xerox 90 g sheets

Measurement speed: A speed was default (24 ppm)

MFT determination: Defined as a lowest temperature where a fixing rate is 90%

Hot Offset Temperature (HOT)

Measurement temperature: A temperature was measured at an interval of 5° C. while changing a temperature from 155° C. to 210° C.

Used paper: Xerox 90 g sheets

Measurement speed: A speed was default (24 ppm)

HOT determination: Defined as a lowest temperature where a hot offset occurred

Image Contamination (Charge-Up)

When 5,000 sheets were printed, a degree of the image contamination caused by charge-up according to a prolonged image output for every 1,000 sheets was measured along with the following standard.

○: Almost no image contamination

Δ: High image contamination x: Very high image contamination

Here, an image contamination caused by charge-up is a phenomenon of a toner being overcharged and sides of the image start to be contaminated. Thus, ○ indicates no image contamination, Δ indicates an image partially contaminated, and x indicates severe contamination, such that the toner is developed on sides of the image as well as the image area.

Developing Properties

An image of a predetermined area was allowed to be developed on a photoreceptor (OPC) before toners were transferred from the OPC to an intermediate transfer member, and then the weight of toner per unit area of the OPC was measured by using a suction apparatus to which a filter is attached. The weight of toner per unit area on a developing roller was simultaneously measured to evaluate the developing properties as follows.

Development efficiency=Weight of toner per unit area of electrophotographic photoreceptor/Weight of toner per unit area of developing roller.

○: Development efficiency of 80% or more

Δ: Development efficiency of 70% or more

X: Development efficiency of 60% or more

Transferring Properties

Through evaluation of the developability, a primary transferability was evaluated by using a ratio of a weight of toner per unit area of the OPC and a weight of toner per unit area of an intermediate transfer member after the toner was transferred from the OPC to the intermediate transfer body. In addition, a secondary transferability was evaluated by using a ratio of a weight of toner per unit area of the intermediate transfer member and a weight of toner per unit area on paper after the toner was transferred to the paper. The transferability was evaluated by using an unfixed image which had not been fixed to measure a weight of toner per unit area on the paper.

Primary transfer efficiency=Weight of toner per unit area on intermediate transfer member/Weight of toner per unit area of OPC Secondary transfer efficiency=Weight of toner per unit area on paper/Weight of toner per unit area of intermediate transfer member Transfer efficiency=Primary transfer efficiency·Secondary transfer efficiency.

○: Transfer efficiency of 80% or more

Δ: Transfer efficiency of 70% or more

X: Transfer efficiency of 60% or more

<Evaluation Result>

Surface characteristics analysis results of the externally added toners prepared in Examples 1 to 3 and Comparative Examples 1 to 4 are summarized in Table 1 below.

TABLE 1

| | $P_{2848}/P_{1493}$ | $TSI_{[Fe]}/TSI_{[C3H7]}$ | $TSI_{[Si]}/TSI_{[Ti]}$ |
|---|---|---|---|
| Example 1 | 1.10 | 0.88 | 4 |
| Example 2 | 0.70 | 0.60 | 6 |
| Example 3 | 0.85 | 1.10 | 5 |
| Comparative Example 1 | 1.30 | 0.80 | 5 |
| Comparative Example 2 | 0.60 | 1.35 | 7 |
| Comparative Example 3 | 0.80 | 0.30 | 7 |
| Comparative Example 4 | 0.95 | 0.70 | 80 |

Performance measurement results for the externally added toners prepared in Examples 1 to 3 and Comparative Examples 1 to 4 are summarized in Table 2 below.

TABLE 2

| | Flowability | Life durability | Developing roller filming | MFT (° C.) | HOT (° C.) | Image contamination (Charge-up) | Transferring properties |
|---|---|---|---|---|---|---|---|
| Example 1 | Δ | ○ | ○ | 160 | 210 | ○ | ○ |
| Example 2 | ○ | ○ | ○ | 165 | 210 | Δ | ○ |
| Example 3 | ○ | ○ | ○ | 165 | Not occurred | ○ | ○ |
| Comparative Example 1 | Δ | x | x | 155 | 200 | ○ | Δ |
| Comparative Example 2 | ○ | ○ | ○ | 170 | Not occurred | x | x |
| Comparative Example 3 | ○ | ○ | ○ | 170 | 210 | x | x |
| Comparative Example 4 | ○ | ○ | ○ | 165 | 210 | ○ | x |

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A toner to develop an electrostatic image, the toner comprising:

a core particle comprising a binder resin, a colorant, and a releasing agent;

a shell layer that surrounds the core particle and comprises a binder resin; and an external additive that is attached on a surface of the shell layer and comprises silica particles and titanium dioxide particles, wherein the core particle and the shell layer further comprise iron, the toner satisfying $0.7 \leq P_{2848}/P_{1493} \leq 1.10$ and $0.60 \leq TSI_{[Fe]}/TSI_{[C3H7]} \leq 1.10$, where $P_{2848}$ and $P_{1493}$ are each respectively peak intensities in a diffuse reflectance FT-IR spectrum of the toner at locations of 2848 $cm^{-1}$ and 1493 $cm^{-1}$, and $TSI_{[Fe]}$ and $TSI_{[C3H7]}$ are each respectively peak intensities in a TOF-SIMS spectrum of the toner corresponding to Fe and $C_3H_7$.

2. The toner of claim 1, wherein the toner satisfies $0.1 \leq TSI_{[Si]}/TSI_{[Ti]} \leq 6.0$, wherein $TSI_{[Si]}$ and $TSI_{[Ti]}$ are each respectively peak intensities in a TOF-SIMS spectrum of the toner corresponding to Si and Ti.

* * * * *

UNITED STATES PATENT AND TRADEMARK OFFICE

CERTIFICATE OF CORRECTION

PATENT NO. : 9,034,547 B2
APPLICATION NO. : 13/956729
DATED : May 19, 2015
INVENTOR(S) : Hae-ree Joo et al.

It is certified that error appears in the above-identified patent and that said Letters Patent is hereby corrected as shown below:

In the claims

Claim 1, Column 18, Line 58

Delete "$TSI_{[Fe]}$and" and insert --$TSI_{[Fe]}$ and--, therefor.

Claim 2, Column 18, Line 63 (Approximately)

Delete "$TSI_{[SI]}$" and insert --$TSI_{[Si]}$--, therefor.

Signed and Sealed this
Thirteenth Day of October, 2015

Michelle K. Lee

Michelle K. Lee
*Director of the United States Patent and Trademark Office*